US010944175B2

(12) United States Patent
Rogers

(10) Patent No.: US 10,944,175 B2
(45) Date of Patent: Mar. 9, 2021

(54) WAVEGUIDE FED SURFACE INTEGRATED WAVEGUIDE ANTENNA AND METHOD FOR PRODUCING SAME

(71) Applicant: The Boeing Company, Chicago, IL (US)

(72) Inventor: John E. Rogers, Owens Cross Roads, AL (US)

(73) Assignee: THE BOEING COMPANY, Chicago, IL (US)

( * ) Notice: Subject to any disclaimer, the term of this patent is extended or adjusted under 35 U.S.C. 154(b) by 17 days.

(21) Appl. No.: 16/443,604

(22) Filed: Jun. 17, 2019

(65) Prior Publication Data

US 2020/0395667 A1 Dec. 17, 2020

(51) Int. Cl.

| | |
|---|---|
| ***H01Q 9/04*** | (2006.01) |
| ***H01Q 13/02*** | (2006.01) |
| ***H01Q 13/20*** | (2006.01) |
| ***H01Q 1/38*** | (2006.01) |

(52) U.S. Cl.

CPC ..... *H01Q 9/045* (2013.01); *H01Q 1/38* (2013.01); *H01Q 13/02* (2013.01); *H01Q 13/0283* (2013.01); *H01Q 13/206* (2013.01)

(58) Field of Classification Search

CPC ..... H01Q 9/04; H01Q 1/38; H01Q 13/02; H01Q 13/20

USPC ..... 343/785

See application file for complete search history.

(56) References Cited

U.S. PATENT DOCUMENTS

2017/0331193 A1* 11/2017 Xue ..... H01Q 9/0457
2018/0269557 A1* 9/2018 Fangfang ..... H01Q 13/106

OTHER PUBLICATIONS

Yang, T.Y., et al., "Wideband Millimeter-Wave Substrate Integrated Waveguide Cavity-Backed Rectangular Patch Antenna", IEEE Antennas and Wireless Propagation Letters, 2014, pp. 205-208, vol. 13.
Yan, L., et al., "Simulation and Experiment on SIW Slot Array Antennas", IEEE Microwave and Wireless Components Letters, Sep. 2004, pp. 446-448, vol. 14, No. 9.
Xu, J.F., et al., "Design and implementation of low sidelobe substrate integrated waveguide longitudinal slot array antennas", IET Microwaves, Antennas & Propagation, 2008, pp. 790-797, vol. 3, Iss. 5.
Luo, G.Q., et al., "Planar Slot Antenna Backed by Substrate Integrated Waveguide Cavity", IEEE Antennas and Nireless Propagation Letters, 2008, pp. 236-239, vol. 7.

(Continued)

*Primary Examiner* — Andrea Lindgren Baltzell
(74) *Attorney, Agent, or Firm* — Gates & Cooper LLP

(57) ABSTRACT

A waveguide antenna and a method for producing same is disclosed. In one embodiment, The waveguide-fed surface integrated antenna array comprises an aperture coupled waveguide (WG) antenna element with inclusive slot on a first metal layer, a first ground plane as part of a surface integrated waveguide (SIW) on a first metal layer, an embedded microstrip feed on a second metal layer, a second ground plane as part of a SIW with one or more apertures formed within the ground plane on a third metal layer, and a waveguide enclosing the antenna element on the first metal layer. The SIW is formed on the first and third metal layers of the composite RF board along with one or more shorting conductors electrically shorting the first and second ground planes.

20 Claims, 8 Drawing Sheets

(56) References Cited

OTHER PUBLICATIONS

Liu, B., et al., "Substrate Integrated Waveguide (SIW) Monopulse Slot Antenna Array", IEEE Transactions on Antennas and Propagation, Jan. 2009, pp. 275-279, vol. 57, No. 1.
Kim, D., et al., "X-band circular ring-slot antenna embedded in single-layered SIW for circular polarisation", Electronics Letters, Jun. 2009, pp. 1-2, vol. 45, No. 13.

* cited by examiner

WAVEGUIDE FED SURFACE INTEGRATED WAVEGUIDE ANTENNA AND METHOD FOR PRODUCING SAME

BACKGROUND

1. Field

The present disclosure relates to antenna systems, and in particular to a waveguide fed surface integrated waveguide antenna and methods for producing such antennas.

2. Description of the Related Art

Conformal sensors substantially conform to the contours of the surface that they are mounted on or of which surface they form a part. Low profile conformal sensor nodes are useful in many applications, including structural health monitoring, diagnostic testing, communications and small aircraft. With regard to structural health monitoring, low-profile, conformal sensor nodes with low size, weight, and power (SWaP) are useful for gathering real time physical information on aircraft (e.g., hoop stress, shear stress, compression, corrosion resistance, bending, torsion, crack growth, high local loads, longitudinal stress and impacts). With regard to diagnostic testing, low-profile wireless conformal sensor nodes with low SWaP are useful for aircraft testing on the factory floor. With respect to communications, low profile wireless conformal sensor nodes with low SWaP are useful on both exterior (e.g., wings and fuselage) and in-cabin surfaces for improved passenger experience including transmit and receive information from nearby transceivers. With respect to small aircraft, light weight antennas with conformal surfaces of low radii of curvature, low radar cross section, and low drag are useful in unmanned air vehicle (UAV) applications.

The SWAP constraints required for such sensors makes a planar antenna with a waveguide feed very appealing. Furthermore, the ability to feed a planar antenna directly from the backside eliminates the need for edge-fed connectors, which increase the overall height of the antenna and complicate the ability to have an antenna flush with the surface.

Planar antennas are typically fed by a microstrip or stripline feed which is connected to a coaxial adapter that enables signal transmission and reception. However, for high frequency applications (e.g. millimeter-wave frequencies), waveguides are preferred over coax for signal transmission and reception due to their inherent low-loss characteristics.

Waveguide-to-coax adapters are commonly used for transitioning from a waveguide to a coax such that a transition can be made to a planar printed circuit board (PCB) with a microstrip. However, microstrip is not desired for high frequency applications due to its conductor and dielectric losses. Existing waveguide-to-coax transitions using commercially available adapters often require two adapters: one for a waveguide to coax transition and another for coax to microstrip transition on a PCB board; such adapters can be cost prohibitive at higher frequencies as such adapters are small requiring high precision computer numerical control (CNC) machining. Also, the size and weight of existing waveguide-to-coax transitions make them non-ideal for many applications.

What is needed is a planar antenna with a low loss waveguide-to-planar-surface integrated waveguide (SIW) transition that meets low SWAP constraints.

SUMMARY

To address the requirements described above, this document discloses a surface integrated waveguide (SIW) antenna array and a method for producing same. In one embodiment, the antenna comprises a circuit board, comprising a composite dielectric. The composite dielectric includes a top planar surface and a bottom planar surface. The top planar surface has a waveguide antenna element and a topside ground plane forming part of the SIW. The bottom planar surface has a bottom side ground plane (opposite the topside ground plane) forming part of the SIW and a SIW antenna element (or aperture) formed within the bottom side ground plane. The antenna further comprises a SIW, formed at least in part by the topside ground plane and the bottom side ground plane, and a conductor, extending through the composite dielectric between the top planar surface and the bottom planar surface, the conductor forming a microstrip extending between and electrically coupling a second waveguide to an input of the SIW via a waveguide antenna element of the second waveguide. The antenna further comprises at least one conductor connecting the topside ground plane to the bottom side ground plane.

The exemplary method of forming an antenna, comprises disposing a topside ground plane on a top planar surface of a first dielectric and a waveguide antenna element on a top planar surface of the first dielectric, disposing a conductor on a top planar surface of a second dielectric, disposing a bottom side ground plane having an aperture on a bottom planar surface of a third dielectric, laminating a bottom planar surface of the first dielectric to a top planar surface of the second dielectric and a bottom planar surface of the second dielectric to a top planar surface of the third dielectric so that a microstrip conductor is formed, the conductor having a first end electrically coupled to the waveguide antenna element and a second end electrically shorted to the SIW. After forming the composite dielectric one or more conductive vias are formed within the dielectric by etching then filling the vias with a conductive material to electrically short the topside ground plane to the bottom side ground plane. Also disclosed is an antenna produced by performing the above described operations.

BRIEF DESCRIPTION OF THE DRAWINGS

Referring now to the drawings in which like reference numbers represent corresponding parts throughout.

DESCRIPTION

In the following description, reference is made to the accompanying drawings which form a part hereof, and which is shown, by way of illustration, several embodiments. It is understood that other embodiments may be utilized and structural changes may be made without departing from the scope of the present disclosure.

Overview

Described below is a low-loss waveguide-to-surface-integrated waveguide (SIW) antenna array that includes a proximity coupled waveguide antenna element on a surface of a radio-frequency (RF) board, an embedded microstrip inside the RF board, a reference ground plane on a backside of the RF board, a waveguide enclosing the waveguide antenna element, and a SIW formed within the RF board with one or more apertures formed in the SIW.

The disclosed waveguide fed SIW antenna array is unique from other planar arrays in that it (1) has an embedded RF microstrip feed electrically coupled to a backside reference ground plane for efficient signal propagation, (2) has a backside reference ground plane to minimize any change in the antenna's electrical behavior due to environmental surfaces (e.g., conductive surfaces), (3) has a waveguide mated to the surface and enclosing the waveguide antenna element, (4) has a SIW embedded in the RF board, (5) has one or more apertures formed in the SIW, (6) has reduced size, weight, and cost in comparison to existing waveguide-to-coax adapters, (7) can be adapted to any waveguide geometric type (e.g., rectangular, circular) for efficient signal propagation, and (8) can be manufactured using a combination of subtractive (e.g., laser etch, milling, wet etching) and additive (e.g., printing, film deposition) methods.

In this disclosure, the terms "top" and "bottom" are used to denote opposing sides of physical elements for purposes of clarity and readability. However, no orientation of such elements is to be inferred. For example, a "top surface" of an element need not be physically oriented above a corresponding "bottom surface" of the element, but rather, simply on an opposing side. Accordingly, the top surface of an element is to be interpreted as a first surface of that element, and the bottom surface of that element is to be interpreted as a second surface on an opposing side of the element from the top surface.

Exemplary Waveguide to SIW Antenna Array

Figure 1A:
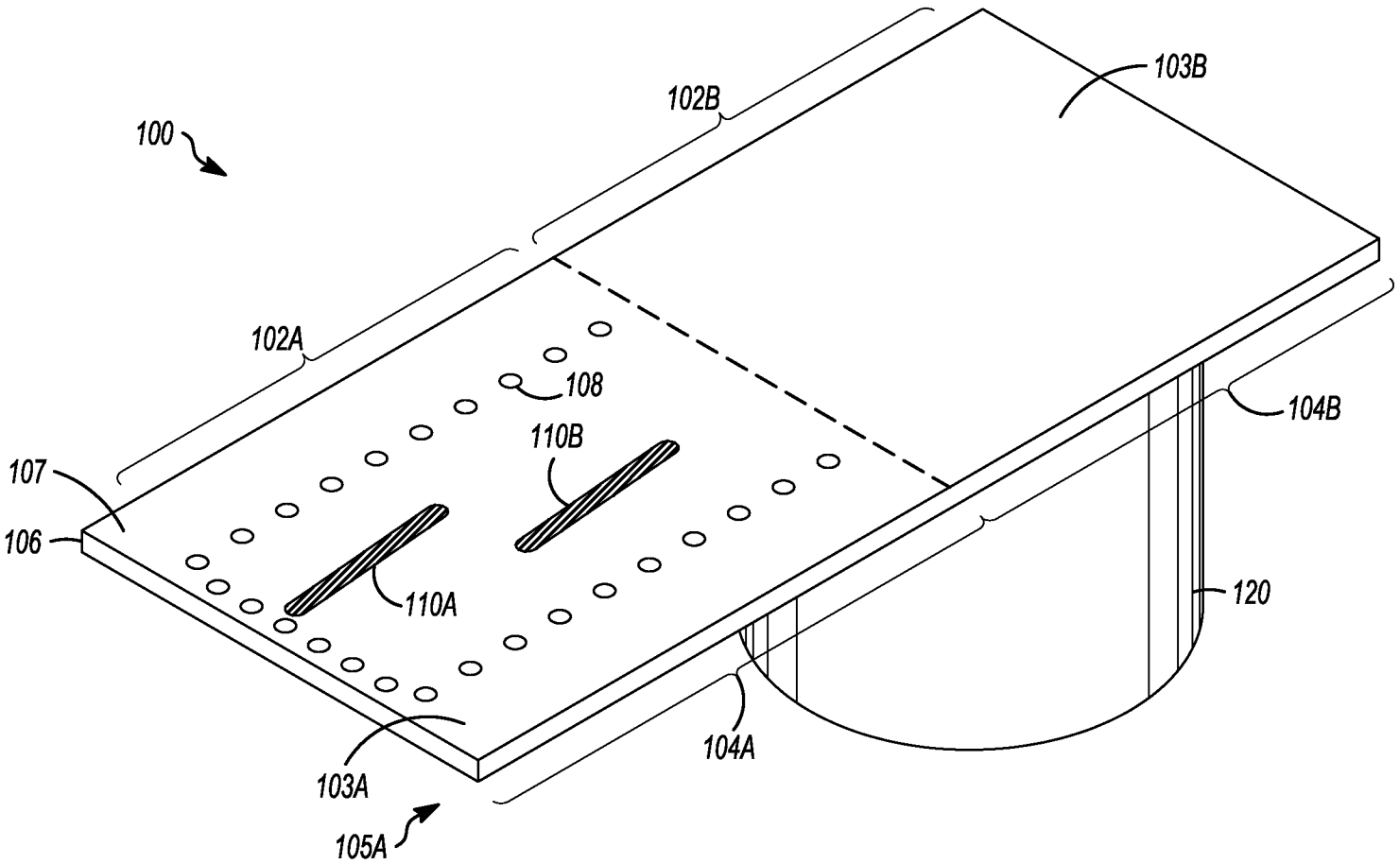
FIGS. 1A and 1B are diagrams illustrating an exemplary embodiment of a waveguide-to-surface-integrated waveguide antenna array.

FIG. 1A is a diagram illustrating an exemplary embodiment of a waveguide-to-surface-integrated waveguide (SIW) antenna array 100. The antenna array 100 has an RF circuit board 106 comprising a multi-layer composite dielectric. The RF circuit board 106 comprises top planar surface 104. The RF circuit board 106 also comprises a bottom planar surface 102. The top planar surface 104 has a topside conductive ground plane 105A disposed on a portion 104A of the top planar surface 104. The top planar surface also has a waveguide antenna element (not shown) disposed on a portion 104B of the top planar surface 104. The bottom planar surface 102 has a bottom side conductive ground plane 103A disposed on portions 102A and 102B of the bottom planar surface 102. The bottom side conductive ground plane 103A has at least one aperture 110. In the illustrated embodiment, the bottom side conductive ground plane 103A comprises a plurality of apertures 110A and 110B.

A SIW 107 is formed at least in part by the topside ground plane 105A and the bottom side conductive ground plane 103A. The SIW 107 and the apertures 110A and 110B together form a SIW antenna 100 having SIW antenna elements. In one embodiment, the SIW 107 is formed by at least one shorting conductor that electrically shorts the topside ground plane 105A to the bottom side ground plane 103A along the periphery of the SIW 107. As shown, a plurality of shorting conductors such as conductive vias 108, are disposed about the periphery of the SIW 107 in the plane of the RF circuit board 106. Each of the conductive vias 108 electrically shorts the topside ground plane 105A to the bottom side ground plane 103A, thus forming the sides of the SIW 107. Hence, the SIW 107 is formed by and is of the dimension established by the topside ground plane 105A, the bottom side ground plane 103A, and the conductive vias 108.

Figure 1B:
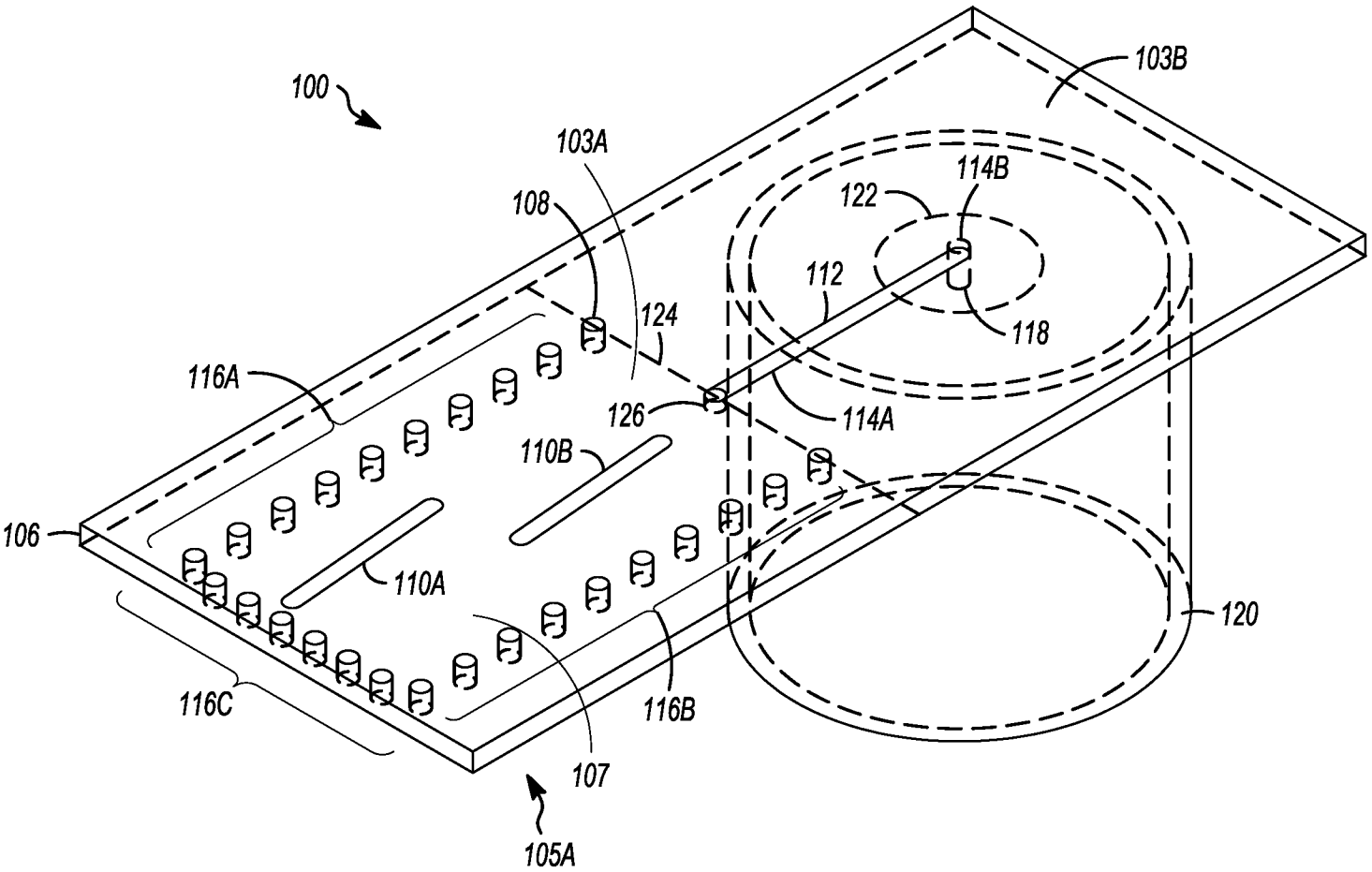

FIG. 1B is another diagram of the antenna array 100 depicted in FIG. 1B, illustrating further structural details. As illustrated, the conductive vias 108 are arranged in a first row 116A of conductive vias and a second row 116B of conductive vias, disposed on opposing sides of the RF circuit board 106 and equidistant from the longitudinal axis of a microstrip conductor 112. Another row 116C of conductive vias 108 forms a closed end of the SIW 107. The opposing end of the SIW 107 is open, and represents an input 124 into the SIW 107.

The microstrip conductor 112 extends through the composite dielectric between the top planar surface 104 and the bottom planar surface 102 forming a microstrip extending between and electrically coupling a waveguide 120 to the input 124 of the SIW antenna via a waveguide antenna element 122. The waveguide 120 comprises a conductive periphery that encloses a cavity and has an axial centerline that is centered over the waveguide antenna element 122 disposed on a portion 104B of the top planar surface 104. The waveguide antenna element 122 includes a slot 118 at a first end 114B of the microstrip conductor 112 forming the microstrip, and the second end 114A of the microstrip conductor 112 extends proximate to the input 124 of the SIW 107. The waveguide 120 is illustrated as circular in cross section, but other cross sections (e.g. rectangular) may be used. A conductive via 126 electrically shorts the second end 114A of the conductor to the topside ground plane 105A. The dimensions of the SIW antenna 100 including the SIW 107 (i.e., length, width, and height), waveguide antenna element 122 (i.e., diameter) with slot 118 (i.e., length and width), and aperture (i.e., length and width) are numerically determined to maximize signal propagation at the desired operating frequency.

Figure 2A:
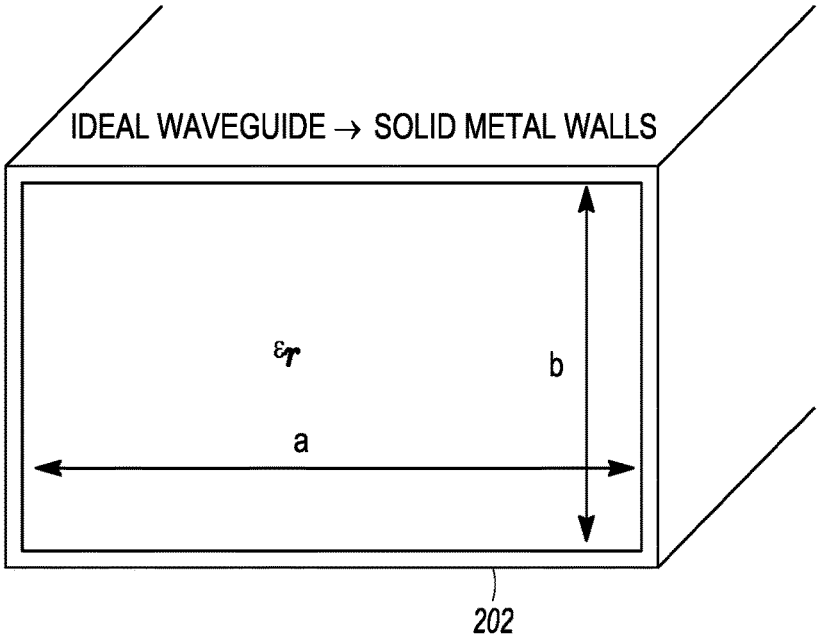
FIGS. 2A-2B are diagrams depicting a comparison of a rectangular waveguide and a surface integrated waveguide as shown in FIGS. 1A and 1B.
Figure 2B:
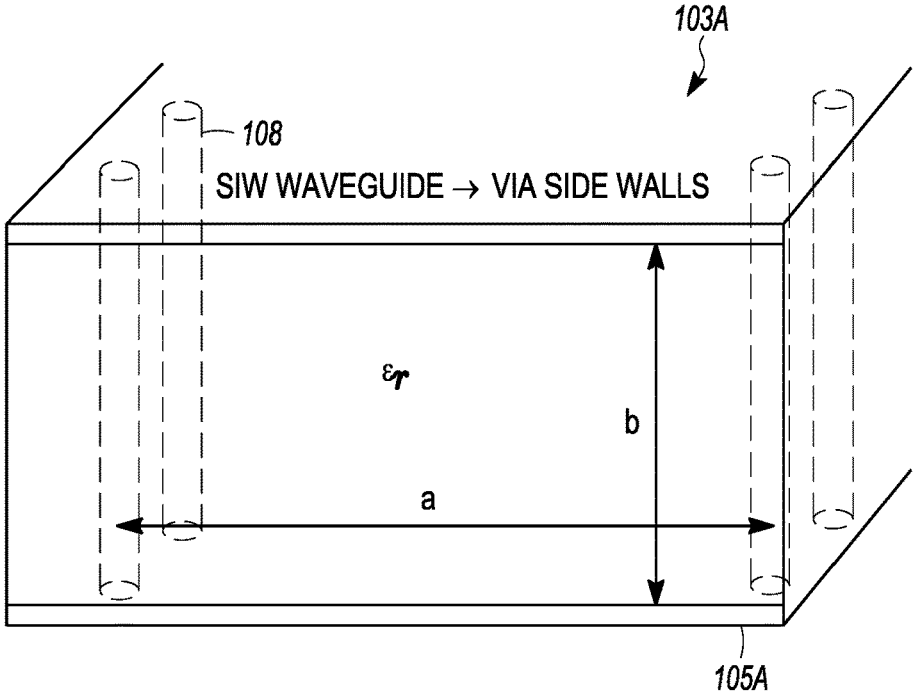

FIGS. 2A-2B are diagrams depicting a comparison of a rectangular waveguide 202 (illustrated in FIG. 2A) and a SIW 107 as shown in FIGS. 1A and 1B. All waveguides have a cut-off frequency, above which the waveguide is unable to efficiently support power transfer along its length.

A rectangular waveguide 202 is rectangular in cross section, with an interior space of width a and height b. The waveguide has solid walls of an electrical conductor (e.g., aluminum or copper) and is typically filled with air as a dielectric medium with a relative permittivity $\varepsilon_r=1$. The desired cutoff frequency $f_0$ for a particular mode in a rectangular waveguide is determined according to equation (1) below.

$$f_0 = \frac{c}{2\sqrt{\mu_r \varepsilon_r}} \sqrt{\left(\left(\frac{1}{a}\right)^2 + \left(\frac{1}{b}\right)^2\right)} \quad \text{Equation (1)}$$

wherein a represents the width of the waveguide, b represents the height of the waveguide, $\varepsilon_r$ is the relative permittivity of the dielectric within the waveguide and $\mu_r$ is the relative permeability of the dielectric within the waveguide. Also note that $$c = \frac{1}{\sqrt{\mu_0 \varepsilon_o}} \quad \text{Equation (2)}$$

where $\mu_0$ is permeability of a vacuum, $\varepsilon_0$ is the permittivity of a vacuum, and c is the speed of light in free space.

Since $\mu=\mu_r\mu_0$ wherein $\mu_r$ is the relative permeability of a dielectric within the waveguide with air having a relative permeability of $\mu_r=1$ and $\varepsilon=\varepsilon_r\varepsilon_0$ wherein $\varepsilon_r$ is the relative permittivity of the dielectric within the waveguide, the cutoff frequency of the waveguide 107 for air can be determined as described in equation (3).

$$f_0 = \frac{c}{2\sqrt{\varepsilon_r}} \sqrt{\left(\left(\frac{1}{a}\right)^2 + \left(\frac{1}{b}\right)^2\right)} \quad \text{Equation (3)}$$

Figure 3A:
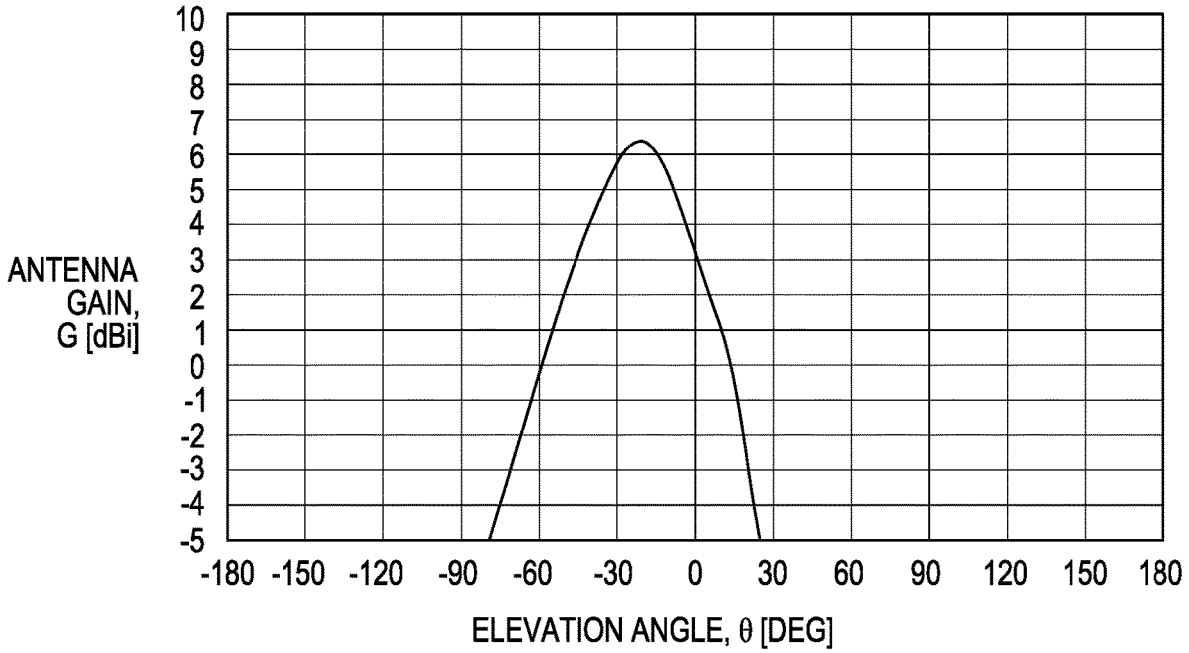
FIGS. 3A and 3B are diagrams illustrating the predicted antenna gain and return loss of the surface integrated waveguide antenna
Figure 3B:
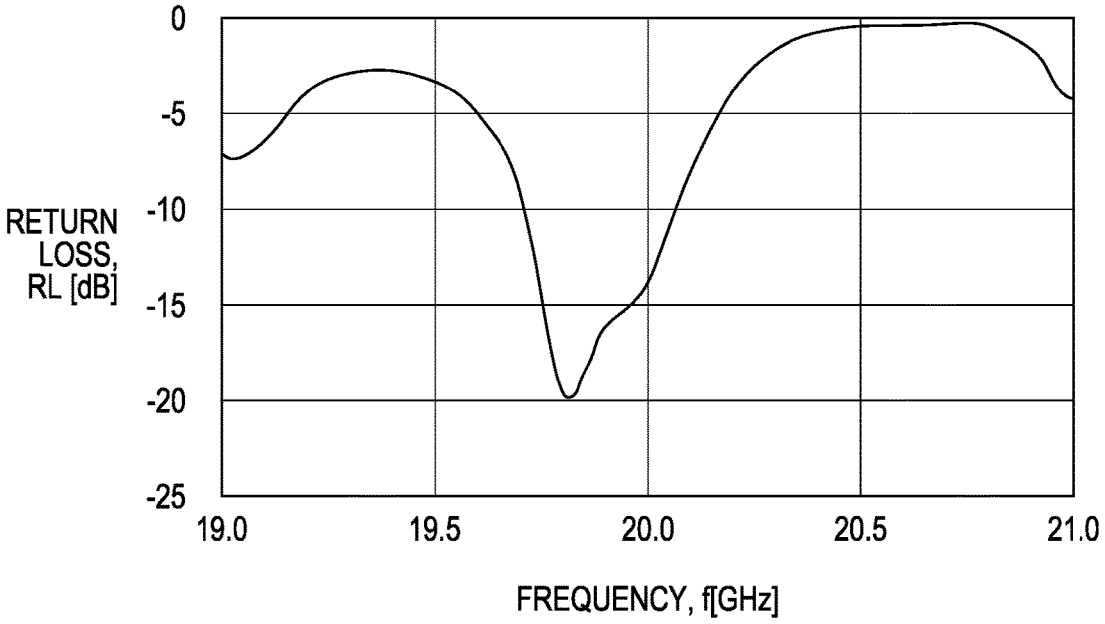

FIGS. 3A and 3B are diagrams illustrating the predicted antenna gain and return loss of the SIW antenna 100. Both plots were generated using a finite element method (FEM) solver. FIG. 3A is a diagram illustrating the predicted antenna gain (in dB) as a function of elevation angle (in degrees). The results show an antenna gain of about 6.4 dBi and a 3 dB beamwidth of about 44 degrees. FIG. 3B is a diagram presenting the predicted return loss (in dB) versus frequency (in GHz). Note that the 3:1 voltage standing wave ratio (VSWR) impedance bandwidth is about 510 MHz.

Figure 4:
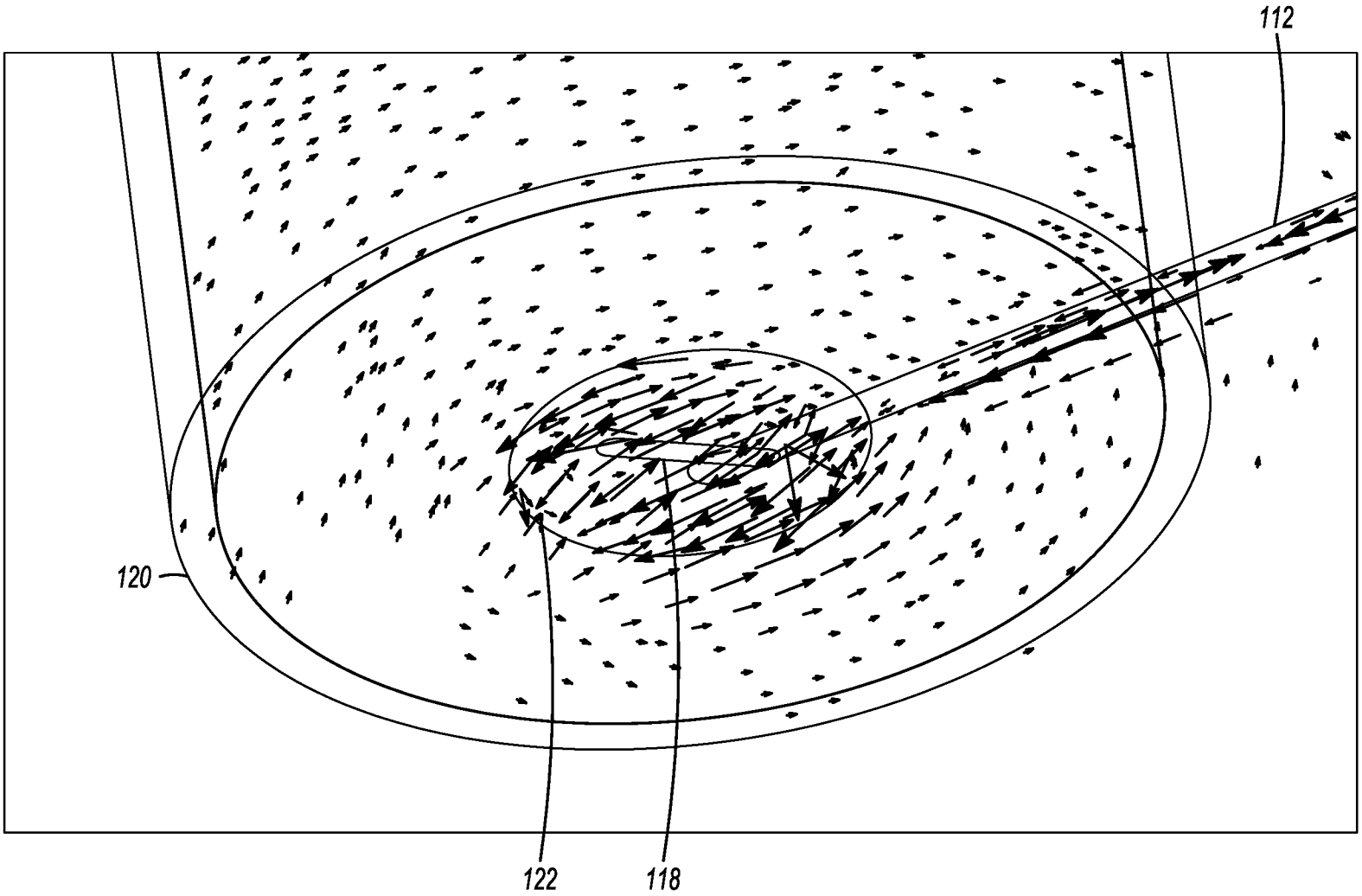
FIG. 4 is a diagram illustrating a field plot showing the current density (in A/m) in vector form for the surface integrated waveguide antenna array

FIG. 4 is a diagram illustrating a field plot showing the current density (in A/m) in vector form for the SIW antenna array 100 operating near 20 GHz. The length of each vector indicates the magnitude of the current density. Current travels down to the waveguide 120, then electrically couples to the waveguide antenna element 122 with inclusive slot 118. The slot 118 causes the current to rotate around the antenna resulting in circular polarization. The current is then electrically coupled to the microstrip line formed by microstrip conductor 112.

Figure 5:
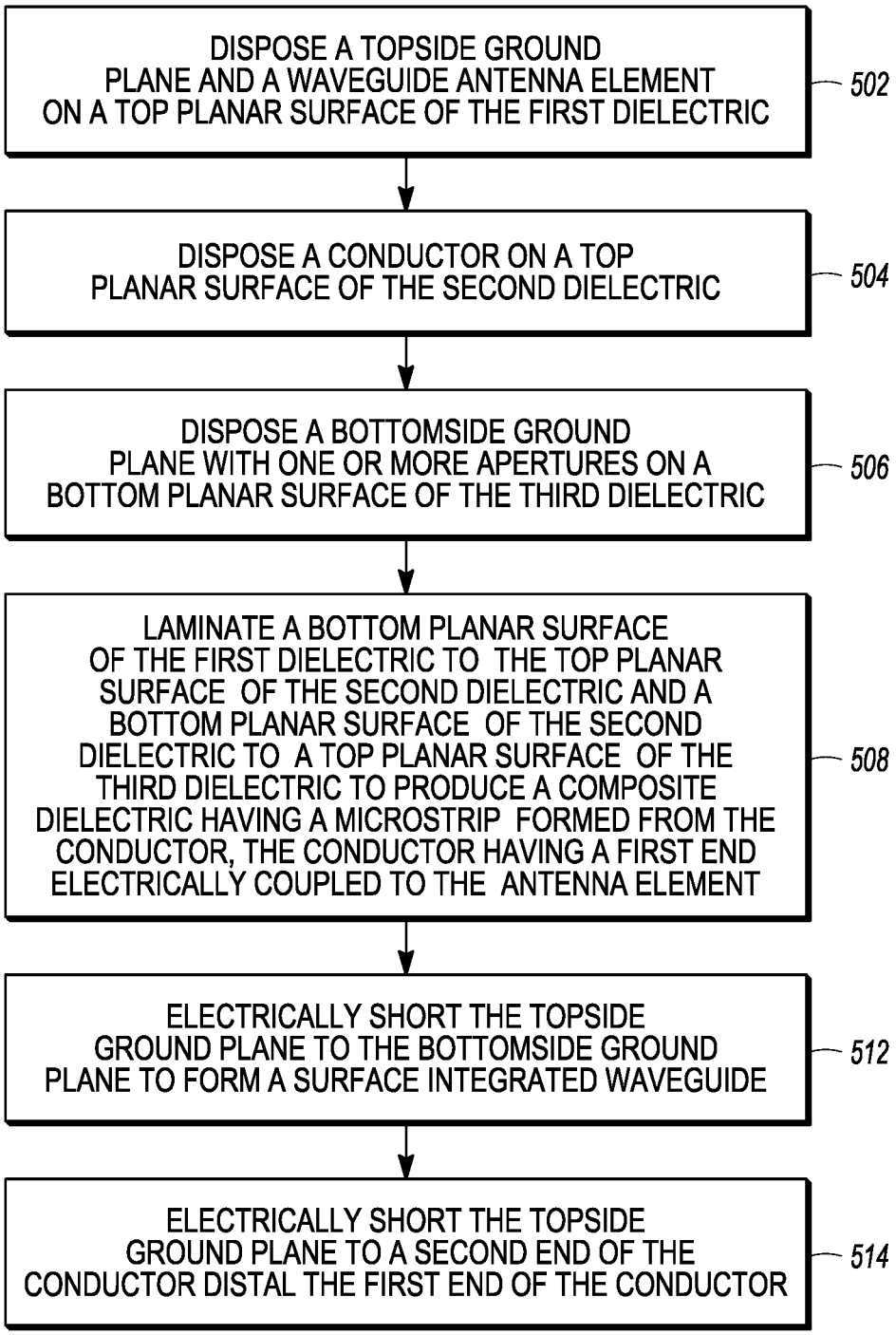
FIG. 5 is a diagram illustrating exemplary method steps that can be used to produce a surface integrated waveguide antenna array
Figure 6:
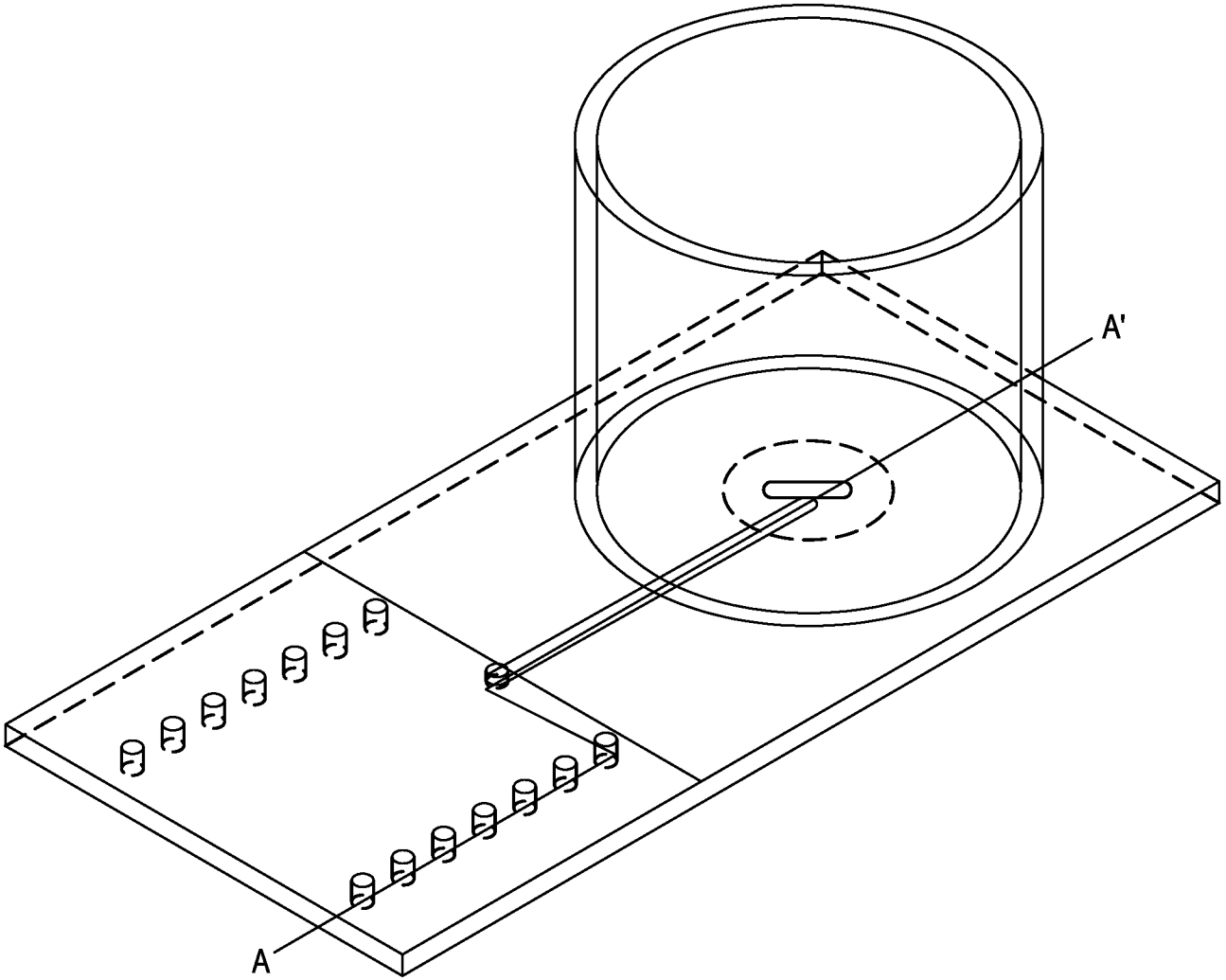
FIG. 6 is a diagram illustrating the location slice A-A' of an exemplary embodiment of the surface integrated waveguide antenna array.
Figures 7A, 7B, 7C, 7D, 7E, 7F:
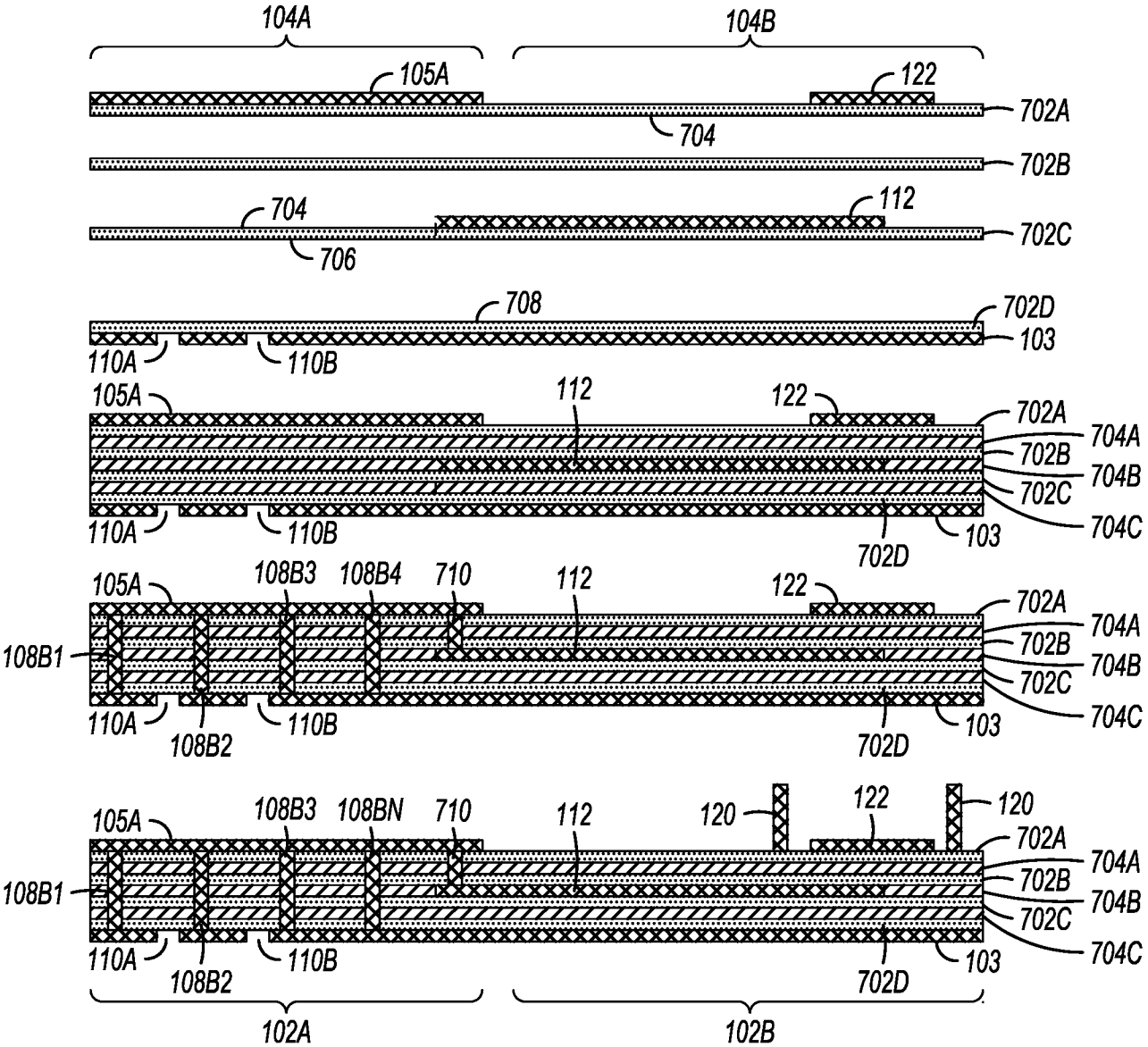
FIGS. 7A-7F are diagrams illustrating one embodiment of a method for producing the antenna array.

FIG. 5 is a diagram illustrating exemplary method steps that can be used to produce a SIW antenna array 100. FIG. 5 is discussed in connection with FIG. 6, and FIGS. 7A-7F, which illustrates the location slice A-A' of an exemplary embodiment of the SIW antenna array 100 and the structure of the A-A' slice during execution of the method steps. The depiction of antenna array 100 in FIGS. 7A-7F is inverted in orientation when compared to the depiction of FIGS. 1A and 1B, however, the references in FIGS. 7A-7F are consistent with the drawings in FIGS. 1A and 1B.

Now referring first to FIG. 5, a topside ground plane 105A and a waveguide antenna element 122 are disposed on a top planar surface 104 of a first dielectric 702A. This is shown in block 502.

A microstrip conductor 112 is disposed on a top surface of a third dielectric 702C, as shown in block 504. A bottom side ground plane 103 having a first portion 103A with one or more apertures 110 and a second portion 103B is disposed on the bottom planar surface 102 of the fourth dielectric 702D. This is shown in block 506.

Next, a bottom planar surface of the first dielectric 702A is laminated to a top planar surface of the second dielectric 702C (with a further dielectric 702B in between), a bottom planar surface of the second dielectric 702C is laminated to a top planar surface of the third dielectric 702D, and a bottom planar surface 706 of the third dielectric 702C is laminated to a top planar surface 708 of the fourth dielectric 702D. These steps are illustrated in block 508. The result of this lamination is presented in FIG. 7D. This lamination may be performed by disposing adhesive films 704A-704C between the respective dielectrics 702A-702D. The result is a composite dielectric having a microstrip formed from the microstrip conductor 112 and bottom side ground plane 103, with the microstrip conductor 112 having a first end 114B electrically coupled to the waveguide antenna element 122.

Next, the topside ground plane 105A is electrically shorted to the bottom side ground plane 103A to form a SIW 107. In the illustrated embodiment, this is accomplished using a plurality of conductive vias 108 including vias 108B1-108BN in row 116B. Vias 108B1-108BN form one side of the SIW 107, and a companion set of electrically conductive vias (not shown in FIG. 7E but illustrated in row 116A of FIG. 1B as they are not on line A-A') form the other side of the SIW. The electrically conductive vias 108 are formed by etching the plurality of vias and filling the etched plurality of vias with conductive material. The electrically conductive vias are disposed about the periphery of the SIW. This is illustrated in block 512.

Also, the topside ground plane 105A is electrically shorted to an end of the microstrip conductor 112 distal from the end of the microstrip conductor 112 that is proximate and electrically coupled to the waveguide antenna element 122. In the illustrated embodiment, this is also accomplished by use of an electrically conductive via 710, formed by etching and filling with conductive material, as described above. This is illustrated in block 514.

The planar conductive surfaces described above can be formed using a variety of techniques including subtractive process techniques such as copper patterning and additive process techniques such as printing with conductive ink.

CONCLUSION

This concludes the description of the preferred embodiments of the present disclosure.

The foregoing description of the preferred embodiment has been presented for the purposes of illustration and description. It is not intended to be exhaustive or to limit the disclosure to the precise form disclosed. Many modifications and variations are possible in light of the above teaching. It is intended that the scope of rights be limited not by this detailed description, but rather by the claims appended hereto.

What is claimed is:

1. An antenna, comprising:

a circuit board, comprising:

a composite dielectric, having:

a top planar surface, having a top conductive ground plane and an antenna element;

a bottom planar surface, having a bottom conductive ground plane with one or more apertures formed in the bottom conductive ground plane;

a surface integrated waveguide (SIW), formed at least in part by the top conductive ground plane on the top planar surface and the bottom conductive ground plane on the bottom planar surface; and a microstrip conductor, extending through the composite dielectric between the top planar surface and the bottom planar surface, the microstrip conductor forming a microstrip extending between and electrically coupling a waveguide to an input of the SIW via the antenna element enclosed within the waveguide;

wherein the aperture and the SIW together form a SIW antenna.

2. The antenna of claim 1, wherein the SIW is further formed by at least one shorting conductor, electrically shorting the top conductive ground plane on the top planar surface to the bottom conductive ground plane on the bottom planar surface.

3. The antenna of claim 1, wherein the SIW is further formed by a plurality of conductive vias, disposed about a periphery of the SIW, each of the plurality of conductive vias electrically shorting the top conductive ground plane on the top planar surface to the bottom conductive ground plane on the bottom planar surface.

4. The antenna of claim 3, wherein:

the plurality of conductive vias include a first row of conductive vias and a second row of conductive vias;

the SIW is dimensioned according to $$f_0 = \frac{c}{2\sqrt{\varepsilon_r}}\sqrt{\left(\left(\frac{1}{a}\right)^2 + \left(\frac{1}{b}\right)^2\right)}$$

wherein:

b is a height of the SIW between the top planar surface and the bottom planar surface of the composite dielectric;

a is a width of the SIW between a first row of conductive vias and the second row of conductive vias; and $\varepsilon_r$ is a permittivity of the composite dielectric between between the top planar surface and the bottom planar surface;

cis the speed of light; and $f_0$ is a desired cutoff frequency of the SIW.

5. The antenna of claim 3, wherein:

the antenna element of the waveguide comprises a conductive surface disposed on the top planar surface of the composite dielectric with the conductive surface having a slot;

the microstrip conductor comprises a first end disposed at the input of the SIW and a second end disposed proximate the slot of the antenna element;

the waveguide is affixed to the top planar surface of the composite dielectric, the waveguide comprising a conductive periphery with a cavity disposed about the antenna element.

6. The antenna of claim 5, wherein the bottom conductive ground plane on the bottom planar surface comprises a plurality of apertures, forming a plurality of SIW antenna elements.

7. The antenna of claim 1, wherein:

the top conductive ground plane and antenna element are formed by a first conductive material on a top surface of a first layer of the composite dielectric;

the microstrip conductor is formed by second conductive material on a top surface of a second layer of the composite dielectric;

the bottom conductive ground plane with one or more apertures is formed by a third conductive material on a bottom surface of a third layer of the composite dielectric.

8. The antenna of claim 7, wherein:

the first conductive material is patterned on the top surface of the first layer of the composite dielectric;

the second conductive material is patterned on the top surface of the second layer of the composite dielectric; and the third conductive material is patterned on the bottom surface of the third layer of the composite dielectric.

9. The antenna of claim 7, wherein the first conductive material is printed on the top surface of the first layer of the composite dielectric;

the second conductive material is printed on the top surface of the second layer of the composite dielectric; and the third conductive material is printed on the bottom surface of the third layer of the composite dielectric.

10. The antenna of claim 7, wherein:

the antenna is formed by:

disposing a first adhesive film between the first layer of the composite dielectric and the second layer of the composite dielectric;

disposing a second adhesive film between the second layer and the third layer of the composite dielectric;

aligning the first, second, and third layers of the composite dielectric; and bonding together the first layer of the composite dielectric, the second layer of the composite dielectric, and the third layer of the composite dielectric with the first adhesive film and the second adhesive film.

11. The antenna of claim 10, wherein the antenna is further formed by:

mating the waveguide having an axial centerline to the top planar surface with the axial centerline aligned to the antenna element of the waveguide.

12. A method of forming an antenna, comprising:

disposing a top conductive ground plane and an antenna element on a top planar surface of a first dielectric;

disposing a microstrip conductor on a top planar surface of a second dielectric;

disposing a conductive ground plane with one or more apertures on a bottom planar surface of a third dielectric;

laminating a bottom planar surface of the first dielectric to the top planar surface of the second dielectric and a bottom planar surface of the second dielectric to a top planar surface of the third dielectric to produce a composite dielectric having a microstrip formed from the microstrip conductor, the microstrip conductor having a first end electrically coupled to the antenna element;

electrically shorting the top conductive ground plane on the top planar surface to the bottom conductive ground plane on the bottom planar surface to form a surface integrated waveguide (SIW); and electrically shorting the conductive ground plane on the top planar surface to a second end of the microstrip conductor distal the first end of the microstrip conductor.

13. The method of claim 12, wherein electrically shorting the top conductive ground plane on the top planar surface to the bottom conductive ground plane on the bottom planar surface to form a SIW comprises:

etching a plurality of vias disposed about a periphery of the SIW between the top conductive ground plane on the top planar surface and the bottom conductive ground plane on the bottom planar surface; and filling the etched plurality of vias with conductive material to produce a plurality of conductive vias.

14. The method of claim 13, wherein:

the plurality of conductive vias include a first row of conductive vias and a second row of conductive vias; the SIW is dimensioned according to $$f_0 = \frac{c}{2\sqrt{\varepsilon_r}}\sqrt{\left(\left(\frac{1}{a}\right)^2 + \left(\frac{1}{b}\right)^2\right)}$$

wherein:

b is a height of the SIW between the top planar surface and the bottom planar surface of the composite dielectric;

a is a width of the SIW between a first row of conductive vias and the second row of conductive vias;

$\varepsilon_r$ is a permittivity of a composite dielectric between the top planar surface and the bottom planar surface;

c is the speed of light; and $f_0$ is a desired cutoff frequency of the SIW.

15. The method of claim 13, further comprising:

affixing a waveguide to the top planar surface of the first dielectric, the waveguide comprising a conductive periphery with a cavity disposed about the antenna element.

16. The method of claim 15, wherein at least one of the top conductive ground plane on the top planar surface, antenna element, the microstrip conductor, and the bottom conductive ground plane on the bottom planar surface are formed according to an additive process.

17. The method of claim 15, wherein at least one of the top conductive ground plane on the top planar surface, antenna element, the microstrip conductor, and the bottom conductive ground plane on the bottom planar surface are formed according to a subtractive process.

18. An antenna, formed by performing steps comprising steps of:

disposing a top conductive ground plane and an antenna element on a top planar surface of a first dielectric;

disposing a microstrip conductor on a top planar surface of a second dielectric;

disposing a conductive ground plane with one or more apertures on a bottom planar surface of a third dielectric;

laminating a bottom planar surface of the first dielectric to the top planar surface of the second dielectric and a bottom planar surface of the second dielectric to a top planar surface of the third dielectric to produce a composite dielectric having a microstrip formed from the microstrip conductor, the microstrip conductor having a first end electrically coupled to the antenna element;

electrically shorting the top conductive ground plane on the top planar surface to the bottom conductive ground plane on the bottom planar surface to form a surface integrated waveguide (SIW); and electrically shorting the conductive ground plane on the top planar surface to a second end of the microstrip conductor distal the first end of the microstrip conductor.

19. The antenna of claim 18, wherein electrically shorting the top conductive ground plane on the top planar surface to the bottom conductive ground plane on the bottom planar surface to form a SIW comprises:

etching a plurality of vias disposed about a periphery of the SIW between the top conductive ground plane on the top planar surface and the bottom conductive ground plane on the bottom planar surface; and filling the etched plurality of vias with conductive material to produce a plurality of conductive vias.

20. The antenna of claim 19, wherein:

the plurality of conductive vias include a first row of conductive vias and a second row of conductive vias; the SIW is dimensioned according to $$f_0 = \frac{c}{2\sqrt{\varepsilon_r}}\sqrt{\left(\left(\frac{1}{a}\right)^2 + \left(\frac{1}{b}\right)^2\right)}$$

wherein:

b is a height of the SIW between the top planar surface and the bottom planar surface of the composite dielectric;

a is a width of the SIW between a first row of conductive vias and the second row of conductive vias;

$\varepsilon_r$ is a permittivity of a composite dielectric between between the top planar surface and the bottom planar surface;

c is the speed of light; and $f_0$ is a desired cutoff frequency of the SIW.

* * * * *